US005497133A

United States Patent [19]

Dawson et al.

[11] Patent Number: 5,497,133

[45] Date of Patent: Mar. 5, 1996

[54] SWITCH WITH IMPROVED CONTACTS FOR USE IN HIGH TEMPERATURE ENVIRONMENTS

[75] Inventors: Arthur W. Dawson, Freeport; Kundan L. Malik, Rockford, both of Ill.

[73] Assignee: Honeywell Inc., Minneapolis, Minn.

[21] Appl. No.: 420,952

[22] Filed: Apr. 12, 1995

[51] Int. Cl.[6] ..... H01H 51/22

[52] U.S. Cl. ..... 335/83; 335/128; 200/265

[58] Field of Search ..... 335/78–80, 124, 335/128, 170, 154, 229; 200/265–266

[56] References Cited

U.S. PATENT DOCUMENTS 3,977,747 8/1976 Broutros ..... 339/176

4,408,173 10/1983 Adlerteg et al. ..... 335/16

4,706,383 11/1987 Saffari .

5,334,811 8/1994 Burgener et al. .

*Primary Examiner*—Lincoln Donovan

*Attorney, Agent, or Firm*—William D. Lanyi

[57] ABSTRACT

A switch is made for use in elevated temperatures. A first stationary contact carrier is made of stainless steel and configured to be rigidly attached to a first stationary contact pad that is made of a nickel silver alloy. A second stationary contact pad of fine silver is used as the normally opened contact. A movable contact pad made of a silver cadmium oxide alloy is movable from a first position in contact with the normally closed first contact pad to a second position in contact with the normally opened second stationary contact pad.

12 Claims, 3 Drawing Sheets

SWITCH WITH IMPROVED CONTACTS FOR USE IN HIGH TEMPERATURE ENVIRONMENTS

BACKGROUND OF THE INVENTION

1. Field of the Invention

The present invention is generally related to switches that are intended for use in high temperature environments and, more particularly, to switches that have contact pads that are particularly selected to maintain their physical integrity and avoid being welded together when used to conduct electrical current at elevated temperatures.

2. Description of the Prior Art

Many different types of electrical switches are well known to those skilled in the art. Certain types of switches are provided with two stationary contacts and a movable contact that is able to move from a first position in electrical communication with a first stationary contact to a second position in electrical communication with a second stationary contact. Typically, one of the stationary contacts is a normally closed contact and the other stationary contact is a normally opened contact. A known construction of a switch comprises a first stationary contact on which a fine silver contact pad is attached or, alternatively, the stationary contact and the silver contact pad can be made entirely of fine silver or an alloy of silver. A second stationary contact is provided with a fine silver contact pad and supported by a nickel iron post. The movable contact pad is typically made of fine silver or silver cadmium oxide material. When the movable contact pad is disposed in contact, under force, against either of the stationary contact pads, elevated temperatures can create a problem situation.

The selection of contact pad material in switches known to those skilled in the art is generally a function of the type of application for which the switch is intended and the temperature of the environment in which the switch will be used. Contact pads in sealed precision switches are typically made of gold for low current applications below approximately 0.05 amperes. For applications in which the current is greater than 0.5 amperes, silver or silver alloy contact pads are generally used. Occasionally, a silver cadmium oxide alloy is used as part of the contact pad set in order to improve the resistance to contact welding at higher current loads. In addition, occasionally a silver alloy Fasaloy GAH, which is a silver-magnesium-nickel alloy, or similar material is used whenever structural strength is required in addition to good electrical performance.

During the development of a high temperature sealed switch, significant difficulty has been experienced with the performance of the normal materials typically used by those skilled in the art. Known combinations of electrical contact pad material failed to perform under the extreme conditions with elevated temperature. In this context, high temperature is taken to mean 750 degrees Fahrenheit continuous duty and 900 degrees Fahrenheit intermittent duty.

Attempts to use gold and some gold alloys have not been successful because gold softens significantly and becomes dimensionally unreliable at elevated temperatures. In addition, gold contact pads are subject to intermetallic bonding between contact surfaces when held in contact under a force provided by a spring at high temperatures. Another significant requirement of switches of this type is that the normally closed stationary contact requires structural strength as well as acceptable electrical performance. The normally closed contact carrier is subjected to the force of the spring in a snap switch when the movable contact is held in place against the normally closed stationary contact. For this reason, a fine silver stationary contact carrier has not been acceptable even in a switch rated for only 325 degrees Fahrenheit. A fine silver movable contact, in combination with a Fasaloy GAH alloy silver normally closed contact, does not work satisfactorily because at high temperatures the Fasaloy GAH alloy does not retain its strength and the structure of the normally closed stationary contact carrier can be deformed. If this deformation occurs, the position of the stationary contact pad does not accurately remain in its intended position and the operating characteristics of the switch are degraded significantly.

U.S. Pat. No. 4,706,383, which issued on Nov. 17, 1987 to Saffari, discloses an electrical contact assembly with composite contact construction. It teaches a method for producing a nonwelding contact assembly for an electrical switch using a composite contact material that is formed by extruding a metal oxide core surrounded by a metal or metal alloy sheath with good welding properties to form a wire of core material having a layer of the metal or metal alloy metallurgically bonded thereto. A segment of the wire is resistance welded to a contact carrier and coined to the desired contact shape after which the layer or the contact surface is sufficiently thin that it is oxidized to provide nonwelding characteristics after a minimum number of switch operations.

U.S. Pat. No. 5,334,811, which issued to Burgener et al on Aug. 2, 1994, discloses a switch with a laminated cover. The switch housing is made with a laminated cover that comprises an inner plate, an outer plate and a metallic sheet that is disposed therebetween. The metallic sheet is formed with a raised portion that defines a raised surface that is a deformable membrane. The protrusion formed in the metallic sheet is disposed through an opening in an outer place. A inner plate has an opening which is aligned with the opening of the outer plate and the three laminae are spot welded together to define a cover. The laminated cover is welded to a housing with a switching mechanism disposed therein.

Because of the problems caused by high temperature applications, it would therefore be significantly beneficial if a sealed switch could be provided with the capability of operating at high temperatures with the ability to withstand the elevated temperatures without having its electrical contact pads weld together or its contact carriers deformed.

SUMMARY OF THE INVENTION

A switch made in accordance with the present invention comprises first and second stationary contact carriers. A first contact pad is rigidly attached to the first stationary contact carrier and the contact pad comprises a nickel silver alloy. A second contact pad is rigidly attached to the second stationary contact carrier and comprises a contact pad made of fine silver. A movable contact carrier is disposed between the first and second stationary contact carriers. A third contact pad is rigidly attached to the movable contact carrier and comprises a silver cadmium oxide alloy. The second stationary contact carrier, in a preferred embodiment of the present invention, is made of a nickel iron alloy. A layer of nickel can be disposed between the second stationary contact carrier and the second contact pad. In a particularly preferred embodiment of the present invention, the first stationary contact carrier is made of stainless steel.

Although the concepts of the present invention can be applied in many different switches, a preferred embodiment of the present invention is used to provide the contact mechanism of a snap switch.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figure 1:
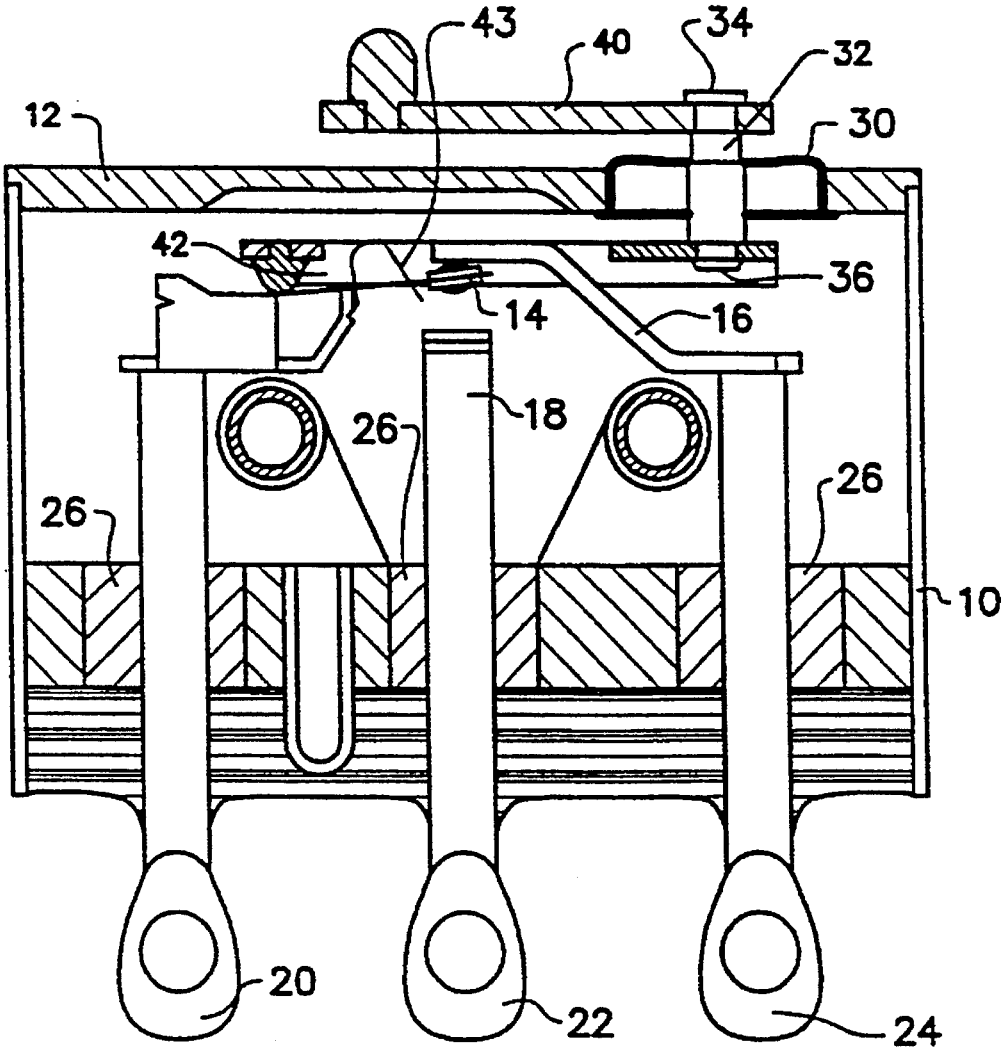
Fig. 1 (PRIOR ART)
FIG. 1 illustrates a hermetically sealed snap switch known to those skilled in the art.

Throughout the Description of the Preferred Embodiment, like components will be identified by like reference numerals.

FIG. 1 illustrates a sealed snap switch made in accordance with concepts that are well known to those skilled in the art. FIG. 1 is a reproduction of FIG. 1 in U.S. Pat. No. 5,334,811 and is provided for the purpose of illustrating the basic structure of a sealed snap switch. The switch in FIG. 1 is a hermetically sealed switch. The housing 10 has a switching mechanism that is disposed therein and a cover 12 that is attached to the housing 10 for the purpose of enclosing the switching mechanism. Since the switch shown in FIG. 1 is well known to those skilled in the art, the specific operation of the switching mechanism will not be described in detail other than to state that a movable contact 14 is caused to alternately move into electrical contact with a first stationary contact 16 and a second stationary contact 18 in response to movement of a lever. The common lead 20, the normally open lead 22 and the normally closed lead 24 extend from the housing through glass bead seals 26. The cover 12 is provided with a deformable membrane 30. The deformable membrane 30 is a generally circular surface of a cup-shaped member that is brazed to the cover 12. A pin 32 has an outer portion 34 and an inner portion 36 which are attached to an external lever 40 and an internal lever 42, respectively. In a manner which is generally known to those skilled in the art, the external lever 40, the internal lever 42 and the pin 32 move in a coordinated manner because of the generally rigid attachment of the two levers to the pin. The deformable membrane 30 can be distorted to permit the internal and external levers to move relative to the cover 12 and the housing 10. This permits a movement of the external lever 40 to cause movement of the internal lever 42 to result in a change of connection status of the switching mechanism within the housing 10.

Figure 2:
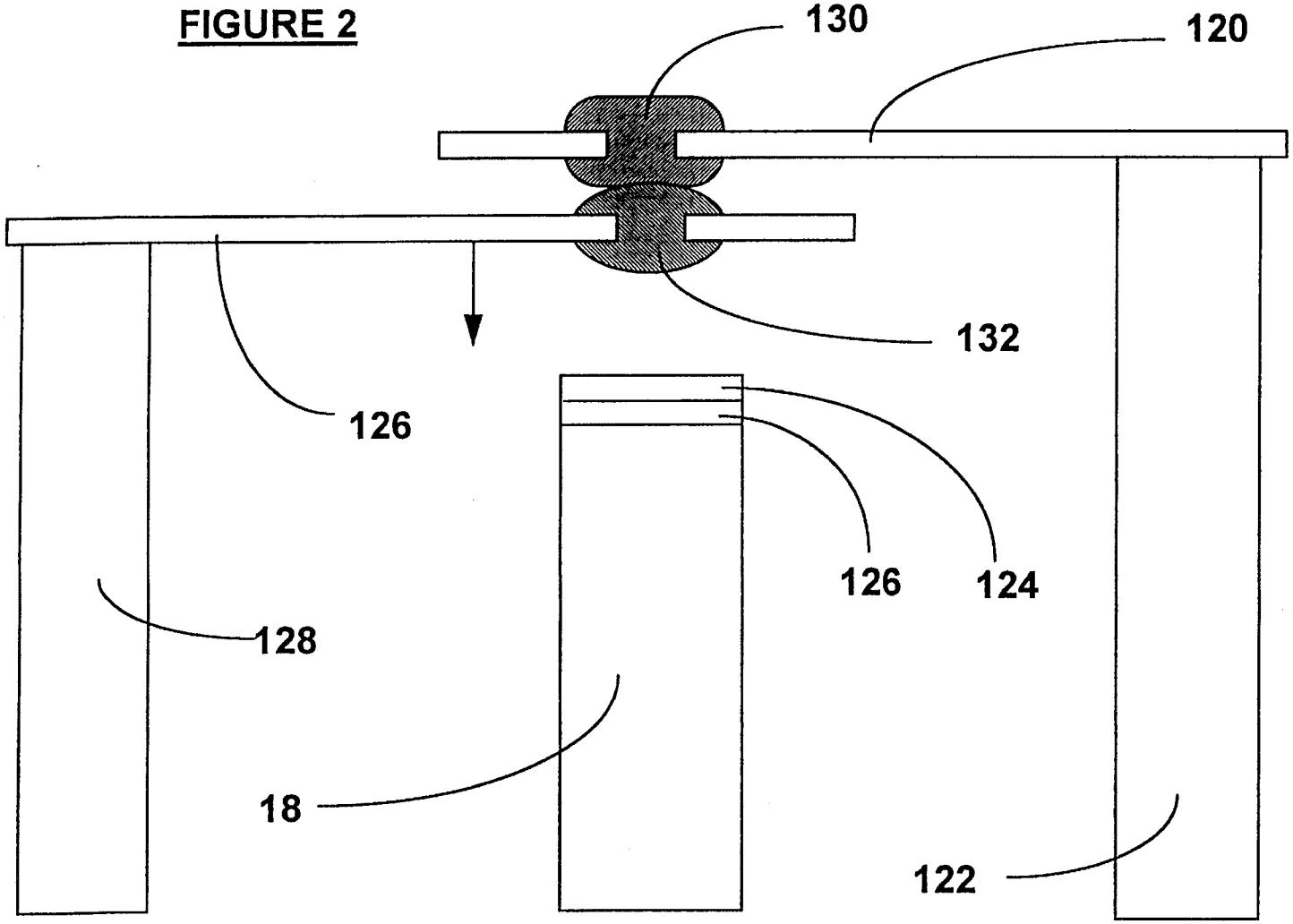
FIG. 2 is a schematic representation of a switch mechanism used to describe the present invention.

FIG. 2 is a schematic representation of the switching mechanism described above in conjunction with FIG. 1. A first stationary contact carrier 120 is supported, in a cantilever manner, by post 122. The first contact carrier 120 is illustrated as a relatively flat plate for purposes of simplifying the illustration of FIG. 2, but it should be understood the first stationary contact carrier 120 could be shaped in a manner similar to that of the stationary contact carrier 16 shown in FIG. 1. A second stationary contact carrier 18 is generally similar to that described above in conjunction with FIG. 1. A fine silver contact pad 124 is attached to the second stationary contact carrier 18. An intermediate layer 126 of nickel facilitates the welding of the fine silver contact pad 124 to the nickel iron material of the second stationary contact carrier 18.

A movable contact carrier 126 is attached to a support structure 128 and is movable from a first position to a second position in the direction illustrated by the arrow in FIG. 2. A first contact pad 130 is rigidly attached to the first stationary contact carrier 120. The contact pad is made of a nickel silver alloy and is formed as a rivet, or button, that is operatively associated with a hole formed in the first stationary contact carrier 120, as shown. A third contact pad 132 is rigidly attached to the movable contact carrier 126 and is made of a silver cadmium oxide alloy.

Figure 3:
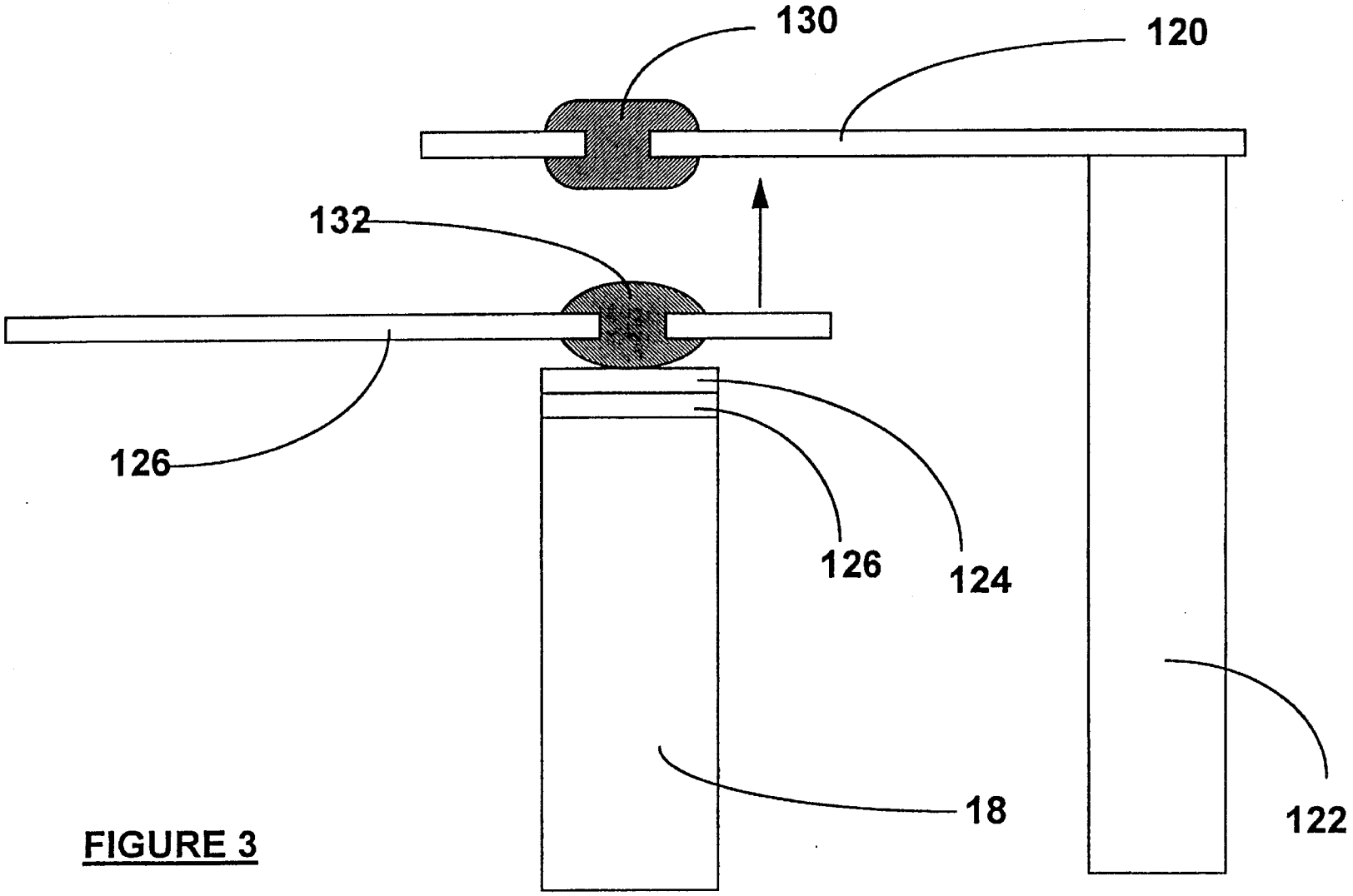
FIG. 3 is an alternative configuration of the components of the mechanism shown in FIG. 2.

FIG. 3 illustrates the movable contact carrier 126 in a position wherein the third contact pad 132 is in contact with the second contact pad 124. As a result of the snap action of the switch, such as the mechanism shown in FIG. 1, the third contact pad 132 is moved out of physical contact with the normally closed first contact pad 130, as illustrated in FIG. 2, and into contact with the second contact pad 124.

Comparing FIGS. 2 and 3 to FIG. 1, several differences between the prior art and the present invention can be described. First, the first stationary contact 16 in the prior art does not comprise a contact pad such as that identified by reference numeral 130. Instead, electrical contact is made directly between the movable contact 14 and the first stationary contact 16 in FIG. 1. Even in applications where a stationary contact pad is used in conjunction with the first stationary contact carrier, or normally closed stationary contact carrier, the contact pad would typically be made of fine silver. If the stainless steel material of the first stationary contact carrier 120 is used without the addition of the nickel silver contact pad 130, the electrical resistance of the first stationary contact assembly will become too high for practical use in high temperature applications because of the reaction of the steel surface with the interior switch environment. If fine silver is used as the first stationary contact pad 130, it has been empirically determined that the first contact pad 130 will stick to the movable contact pad 132 in response to the force exerted upward against the first contact pad 130 by the spring action of the movable contact carrier 126 under increased temperature. This same problem occurs if a silver cadmium oxide contact pad is used in conjunction with the stainless steel stationary contact carrier 120. In addition, the use of fine silver or silver cadmium oxide as the first contact pad 130 also resulted in weak intermetallic bonds between the contact pad and the stationary contact carrier 120. This resulted in changing operational characteristics of the switch, especially its operating point.

Numerous parameters and material characteristics have to be considered when designing a sealed switch for use in high current and high temperature applications. Naturally, the selected materials must have a melting point above the intended operating temperature. However, other characteristics also limit the material selection and the design of this type of switch. For example, certain materials experience a change in physical properties even at temperatures below their melting point. For example, gold becomes excessively soft before it reaches its melting point. This change in hardness of a gold contact pad creates serious problems because the gold will tend to change shape and to form an intermetallic bond with its associated contact pad in which it is placed in contact for an extended duration. In addition, the attachment between the carrier and its associated contact pad must be firm and reliable. Any change in the physical relationship between a contact carrier and its contact pad will result in unreliable performance and changing characteristics. Since most applications rely on the precise operation of a switch, wherein the contact connection relationship within the switch changes precisely at a predetermined position relative to the position of the external lever 40, any change of this characteristic is significantly disadvantageous. Through numerous empirical tests of alternative materials and structures, it has been determined that a high temperature and high current switch design is optimized by selecting a nickel silver contact pad 130 in combination with a stainless steel normally closed contact carrier 120 and a movable contact pad 132 made of a silver cadmium oxide alloy. This combination of materials is able to maintain its physical integrity and shape over temperature ranges that include 750 degrees Fahrenheit continuous duty and 900 degrees Fahrenheit intermittent duty. In addition, the movable contact pad 132 does not weld to the first stationary contact pad 130 even though these two contact pads are held in contact by the force of a spring over relatively long durations.

The use of a second stationary contact pad made of fine silver is not, in itself, novel. In addition, the use of a silver cadmium oxide alloy as the movable contact pad 132 is not, in itself, novel. However, the use of a nickel silver alloy as the stationary contact pad 130, in combination with a silver cadmium oxide alloy movable contact pad 132 is not generally known to those skilled in the art. This combination of the first stationary contact carrier 120 made of stainless steel, the first stationary contact pad 130 made of a nickel silver alloy and the movable contact pad 132 made of a silver cadmium oxide alloy provides the physical integrity of the switching mechanism at elevated temperatures and currents while also providing consistent and reliable operating characteristics of the switch.

The nickel silver alloy used to make the first stationary contact pad 130, in a preferred embodiment of the present invention, is made of about 10% nickel and about 90% silver. The silver cadmium oxide alloy used to make the movable contact pad 132 is 85 to 90% silver and 10 to 15% cadmium. When certain components are described as being fine silver, this terminology typically means that the material is at least 99.9% silver.

Although the present invention has been described with particularly specificity and illustrated to show a particularly preferred embodiment of the present invention, it should be understood that alternative embodiments are within its scope.

The embodiments of the invention in which an exclusive property or right is claimed are defined as follows:

1. A switch, comprising:

a first stationary contact carrier;

a first contact pad rigidly attached to said first stationary contact carrier, said first contact pad comprising a nickel silver alloy;

a second stationary contact carrier;

a second contact pad rigidly attached to said second stationary contact carrier, said second contact pad comprising fine silver;

a movable contact carrier; and a third contact pad rigidly attached to said movable contact carrier, said third contact pad comprising a silver cadmium oxide alloy.

2. The switch of claim 1, wherein:

said second stationary contact carrier is made of a nickel iron alloy.

3. The switch of claim 1, further comprising:

a layer of nickel disposed between said second stationary contact carrier and said second contact pad.

4. The switch of claim 1, wherein:

said first stationary contact carrier is made of stainless steel.

5. The switch of claim 1, wherein:

said switch is a snap switch.

6. A switch, comprising:

a first stationary contact carrier, said first stationary contact carrier being made of stainless steel;

a first contact pad rigidly attached to said first stationary contact carrier, said first contact pad comprising a nickel silver alloy;

a second stationary contact carrier;

a second contact pad rigidly attached to said second stationary contact carrier, said second contact pad comprising fine silver;

a movable contact carrier; and a third contact pad rigidly attached to said movable contact carrier, said third contact pad comprising a silver cadmium oxide alloy.

7. The switch of claim 6, wherein:

said second stationary contact carrier is made of a nickel iron alloy.

8. The switch of claim 7, further comprising:

a layer of nickel disposed between said second stationary contact carrier and said second contact pad.

9. The switch of claim 6, wherein:

said switch is a snap switch.

10. A switch, comprising:

a first stationary contact carrier, said first stationary contact carrier being made of stainless steel;

a first contact pad rigidly attached to said first stationary contact carrier, said first contact pad comprising a nickel silver alloy;

a second stationary contact carrier, said second stationary contact carrier being made of a nickel iron alloy;

a second contact pad rigidly attached to said second stationary contact carrier, said second contact pad comprising fine silver;

a movable contact carrier; and a third contact pad rigidly attached to said movable contact carrier, said third contact pad comprising a silver cadmium oxide alloy.

11. The switch of claim 10, further comprising:

a layer of nickel disposed between said second stationary contact carrier and said second contact pad.

12. The switch of claim 10, wherein:

said switch is a snap switch.

* * * * *